US006003533A

United States Patent [19]

Midcap

[11] Patent Number: 6,003,533

[45] **Date of Patent: *Dec. 21, 1999**

[54] WALKING AID SAFETY TIP

[76] Inventor: Matthew E. Midcap, 175 Belle Chase Dr., Lexington, S.C. 29072

[ * ] Notice: This patent is subject to a terminal disclaimer.

[21] Appl. No.: 09/017,489

[22] Filed: Feb. 2, 1998

Related U.S. Application Data

[63] Continuation of application No. 08/648,388, May 15, 1996, Pat. No. 5,713,382.

[51] Int. Cl.[6] ..... A45B 9/04

[52] U.S. Cl. ..... 135/84; 135/77; 135/86; 135/44

[58] Field of Search ..... 135/77, 67, 68, 135/70, 82, 84, 86, 44; 248/188.9

[56] References Cited

U.S. PATENT DOCUMENTS

| | | |
|---|---|---|
| D. 112,174 | 8/1938 | Levine . |
| D. 113,236 | 2/1939 | Nicholson . |
| D. 272,677 | 2/1984 | Bove et al. . |
| 332,684 | 12/1885 | Tuttle . |
| D. 359,162 | 6/1995 | Knight . |
| D. 404,345 | 1/1999 | Donets . |
| 624,207 | 5/1899 | Hawley, Jr. . |
| 710,073 | 9/1902 | Pratt et al. . |
| 879,471 | 2/1908 | Kabureck . |
| 1,406,453 | 2/1922 | Fanning . |
| 2,633,599 | 4/1953 | Dolan . |
| 3,170,475 | 2/1965 | Forbes . |
| 3,273,575 | 9/1966 | Aldrich . |
| 4,027,687 | 6/1977 | McGowan . |
| 4,098,283 | 7/1978 | Tritle, Jr. . |
| 4,630,626 | 12/1986 | Urban . |
| 4,899,771 | 2/1990 | Wilkinson . |
| 5,301,703 | 4/1994 | Kahn . |
| 5,301,704 | 4/1994 | Brown . |
| 5,331,989 | 7/1994 | Stephens . |
| 5,392,801 | 2/1995 | Hannoosh et al. . |
| 5,409,029 | 4/1995 | Davis . |

FOREIGN PATENT DOCUMENTS

| | | |
|---|---|---|
| 386643 | 12/1920 | Germany . |

*Primary Examiner*—Beth Aubrey
*Attorney, Agent, or Firm*—Robert E. Bushnell

[57] ABSTRACT

An improved walking aid tip that is easy to use and provides for better support on smooth or slippery surfaces. The tip combines the features of an enlarged base for better stability on sand and gravel, a combination of convex and flat base to provide support for the user when the walking aid is positioned at a wide variety of angles with the ground surface, where the user is walking or standing still, a base made of a non-flexible rubber material so that the cane does not wobble and become unstable when in use and so that the base does not crack easily and have to be replaced frequently, an enlarged rigid support member that entirely covers and supports the rubber base so that the cane is less apt to wobble and so that the base is less likely to crack and have to be replaced prematurely, and a socket, a threaded screw, and a threaded screw hole to allow for easy installation of the tip. The enlarged base also allows people who would normally have to use a more cumbersome quad cane (e.g., with four heads) to use a more streamlined but yet supportive single head cane tip.

28 Claims, 3 Drawing Sheets

WALKING AID SAFETY TIP

CLAIM OF PRIORITY

This application makes reference to, incorporates the same herein, and claims all benefits accruing under 35 U.S.C. § 119 from applications for WALKING AID SAFETY TIP earlier filed in the United States Patent & Trademark Office on May 15, 1996, and duly assigned Ser. No. 08/648,388 and matured into U.S. Pat. No. 5,713,382 on the of Feb. 3, 1998 thereafter.

FIELD OF THE INVENTION

The present invention relates to improvements in walking aids, and more particularly, to a cane or crutch tip providing improved stability.

BACKGROUND OF THE INVENTION

Tips for ambulatory aids such as canes or crutches in use today are conventionally molded from rubber to have a flat or concave bottom surface about one and one-half to two inches in diameter. I have discovered that these conventional cane and crutch tips perform poorly for several reasons. First, because they are made of molded flexible rubber, conventional tips tend to slip on smooth floors, wet surfaces, and loose surfaces such as gravel and sand, resulting in a potentially dangerous situation for the user. Second, because these conventional tips are often flat bottomed, they must be placed precisely flat on the surface of the floor in order to provide stable support to their user. Third, I have found that conventional tips are often too small to provide adequate support on a ground surface covered by a loose material such as snow, sand or gravel. Conventional tips often sink several inches into loose sand and cause the user to lose balance or even fall, and I have noticed that many individuals have foregone the use of a cane in favor of a more stable, albeit cumbersome walker. Fourth, I have found that because conventional cane tips use a molded flexible rubber material, they tend to become unstable and wobble when in use. Fifth, because the conventional tips are made of molded flexible rubber and because there is little or no rigid material supporting these rubber tips, the conventional tips have a very limited life as they tend to crack easily with use. Thus, conventional cane tips often have to be replaced quite frequently.

There have been several efforts to overcome some of the above deficiencies. The Crutch Tip Construction of Urban, U.S. Pat. No. 4,630,626 proposes a tip made of a resilient, elastomeric rubber, an enlarged tip, and a rigid plastic or metallic socket for receiving the cane or crutch. A later effort, Wilkinson, U.S. Pat. No. 4,899,771 for a Walking Aid discloses a rocker shaped tip for a cane having a large rectangular bottom surface area and a pair of curved edges to permit the user to permit limited tilting of the cane or crutch during walking. Another effort, U.S. Pat. No. 4,098,283 for Specialized Crutch Tips to Tritle, Jr. provided a cane tip with a disk having a convex lower surface surrounded by a flat peripheral disk, or ride, to cut into and grab sand to prevent slippage. More recent designs such as the Radial Crutch Tip Assembly shown in U.S. Pat. No. 5,409,029 to Davis and the Walking Cane Usable on Slippery and Icy Surfaces in U.S. Pat. No. 5,301,704 to Brown rely upon a curved lower surface generally configured in the shape of a knob allowing the user to slightly tilt their appliance while walking. I have discovered however, that in use these knob-like tips tend to restrict the motion of the appliance to a direction lying within a plane parallel to the ground, a limitation that tends to make the use of the cane or crutch awkward while changing direction in mid-stride. Both designs purport to use a non-slip bottom surface.

SUMMARY OF THE INVENTION

Accordingly, it is an object of the present invention to provide an improved tip for ambulatory appliances such as canes and crutches.

It is another object to provide a tip for canes and crutches interposing a non-flexible material between the bearing surface of the appliance and the surface of the ground reinforced with a textile.

It is yet another object to provide a tip for canes and crutches that is not flexible or resilient so that the cane or walking aid will not wobble or become unstable when used.

It is still another object to provide canes and crutches that minimize the possibility of slipping on a smooth surface.

It is yet another object to provide a tip with a cross sectional surface area three times or more greater than the tip cross sectional surface area of the lowermost end of a cane or crutch in use to allow for better support when in use on a loose or granular surface.

It is still yet another object to provide an enlarged rigid supporting surface that entirely covers and supports the entire rubber base.

It is a further object to provide a tip for canes and crutches that has a convex base and allows the user to walk through in any direction regardless of the orientation of the cane.

It is a yet further object to provide a tip for a walking aid that can be easily installed and removed by simply screwing or unscrewing a single threaded fastener.

These and other objects may be attained with a walking tip constructed according to the principles of the present invention with a rigid member having a tubular section forming an open ended socket to receive a load bearing end of a cane or a crutch. The rigid member extends outwardly from the open end of the tubular section to provide an enlarged supporting surface having a circular cross section with a diameter at least twice as large as the inside diameter of the socket.

It is desirable to have a tip with a greatly enlarged bottom surface area made of a non-flexible durable rubber material to allow for better stability when in use. It is also desirable to have a commensurately large supporting metallic or rigid plastic surface to support the outer periphery of the base to prevent the base from cracking, hence extending the length of the life of the base.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
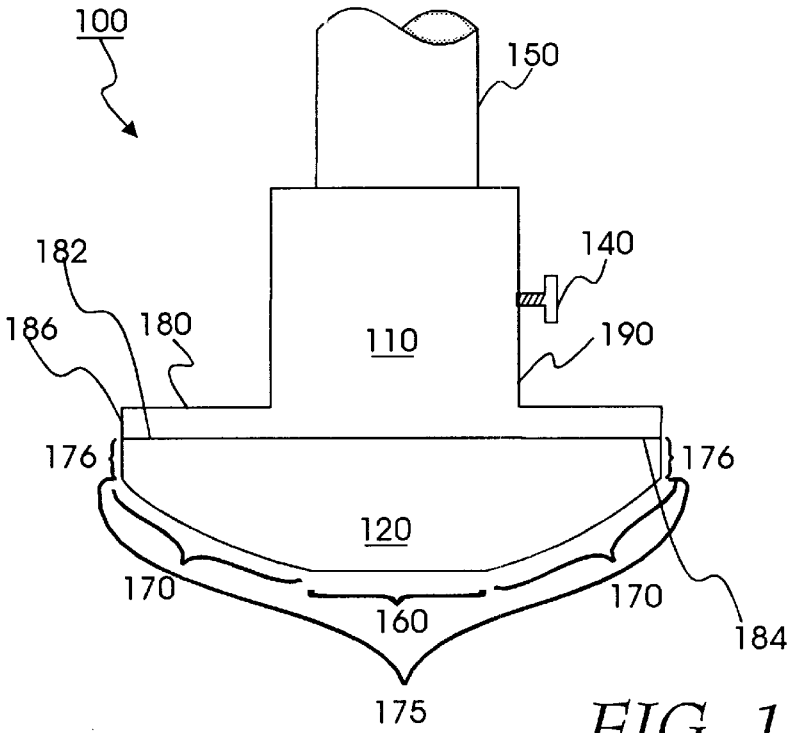
FIG. 1 is a side view showing one embodiment of the present invention as mounted on the end of a cane or crutch.
Figure 2:
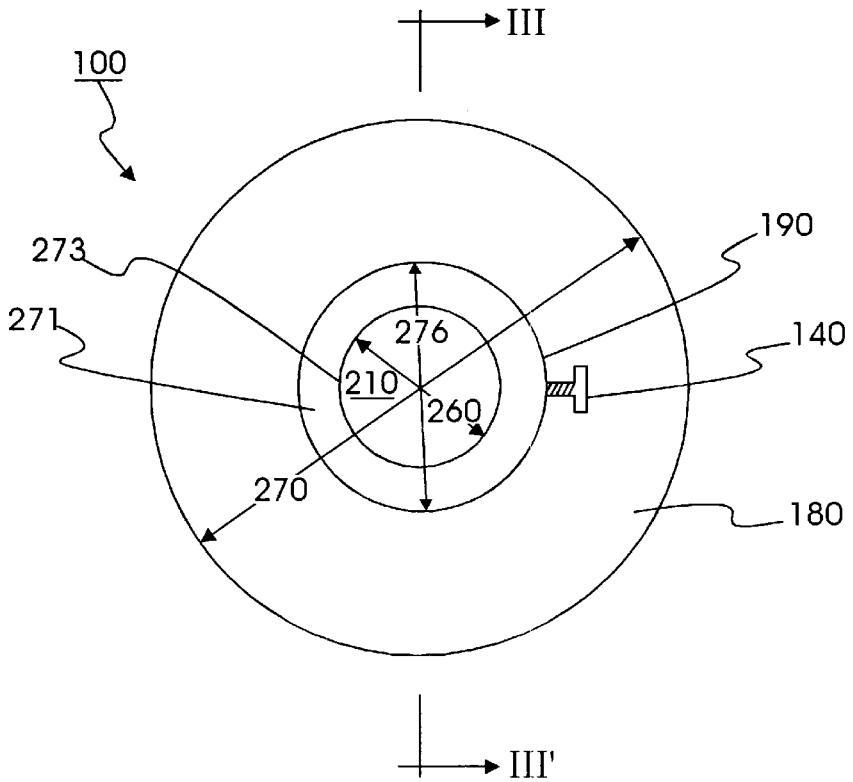
FIG. 2 is a top view of the embodiment shown in FIG. 1.
Figure 3:
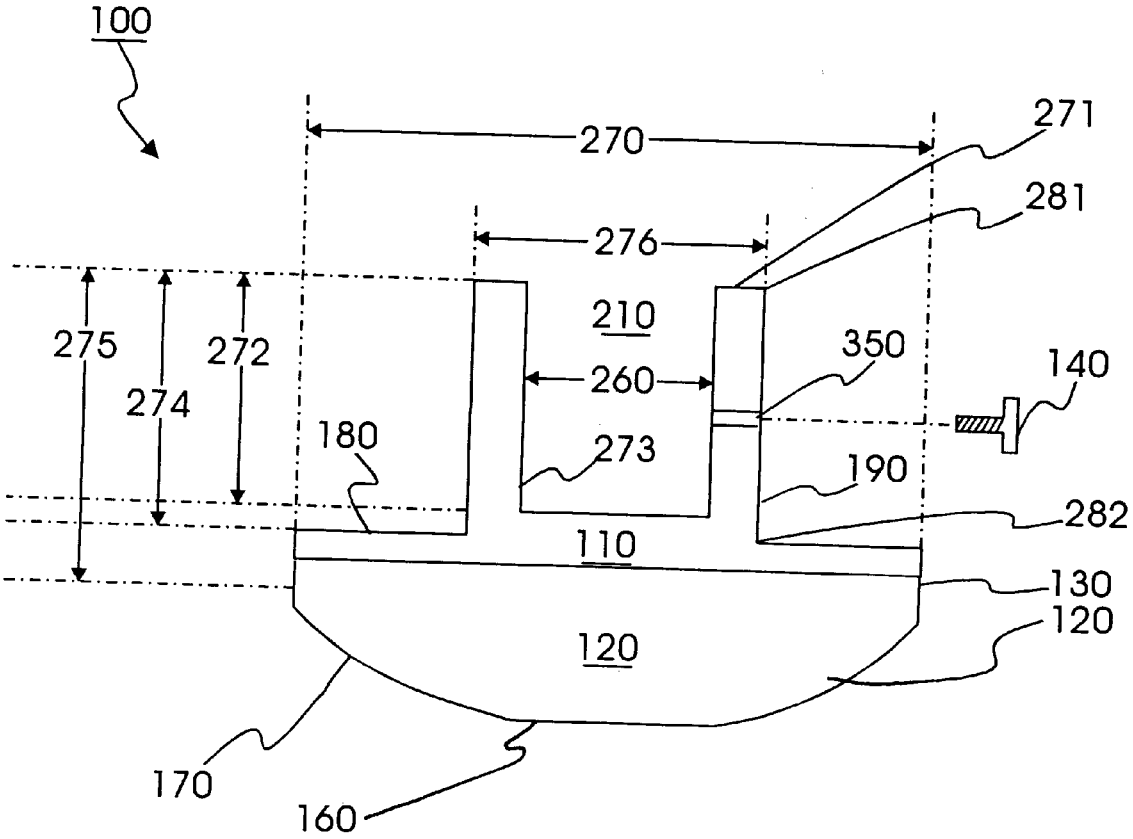
FIG. 3 is a cross section of the embodiment shown in FIG. 1 taken along sectional line III–III' in FIG. 2.

Turning now to the drawings, FIGS. 1, 2, and 3 show the details of the construction of the first embodiment of the present invention. Walking aid tip 100 is positioned on the distal load bearing end of walking aid 150. The first unit of walking aid tip 100 is the circular top, or supporting unit 110 which is made of a rigid material such as aluminum or rigid plastic. A side view of support unit or rigid monolithic circular member 110 is shown in FIG. 1, a top view is shown in FIG. 2, and a cross-section is shown in FIG. 3. Supporting unit 110 serves two purposes. First, socket 210 on the top surface of supporting unit 110 accommodates the distal load bearing end of walking aid 150. A threaded member or screw 140 extends through hole 350 in socket wall 190 and serves to fasten walking aid 150 to walking aid tip 100. Second, an enlarged supporting surface 180 extending from socket 210 to periphery 186 covers the entire top side 184 of rubber base 120, providing better support for the user and decreasing the frequency with which the base needs to be replaced because of cracking.

The second unit of the walking aid tip 100 is the circular rubber base 120. The rubber base 120 is made from recycled mine conveyor belt rubber of a sufficient thickness, reinforced with a fibrous textile material. Typically, mine conveyor belt material comes in a three layer sandwich. The top and bottom layers are thin while the middle layer, or the carcass, is relatively thick. The carcass is what is used in this invention and is generally composed of Styrene-butadiene (SBR), a synthetic rubber that is then reinforced with nylon and/or polyester. SBR is manufactured by Goodyear Tire and Rubber Co. and is characterized as having "excellent abrasion resistance and good resistance to cutting, gouging, and tearing." See the *Conveyor and Elevator Belt Handbook,* published by the Rubber Manufacturers Association, Inc. 1989. SBR is relatively inflexible compared to the plastics or natural rubbers used in conventional canes, allowing for better stability when used and allowing for longer life as the tip is less likely to wobble and crack. The fibrous reinforcement causes base 120 to have a coarse or rough texture, allowing device 100 to be more skid resistant on slippery floors and surfaces.

The base 120 has a top surface 184 that adjoins the bottom side 182 of the supporting unit 110. Top surface 184 of the base 120 is of the same size and shape as the bottom side 182 of the supporting unit 110. The bottom surface 175 of base 120 serves as a ground-engaging surface, and has two distinct regions. The first region found on ground-engaging side 175 of base 120 is the flat and is referred to as the center region 160. This center region 160 is circular and lies coaxially to and directly underneath socket 210. Center region 160 is parallel to both the bottom of socket 210 as well as the bottom surface 182 of supporting unit 110. The second region on ground-engaging side 175 of the base 120 is a convex curved region 170 extending over a ring from center region 160 to outer periphery 176. Although curved region 170 can be made by grinding the SBR material, the preferred method of manufacturing base 120 with curved region 170 is to use a stamping machine with a clicking device and a die, molded to the desired size and shape of the rubber base.

The bottom surface 182 of supporting unit 110, being of equal size and shape as the top surface 184 of base 120, completely covers base 120. As a result, supporting unit 110 prevents instability during the operation of the walking aid. Because supporting unit 110 is made of a rigid material, and because it covers the entire top surface 184 of base 120, walking aid tip 100 is less apt to wobble than walking aids with conventional tips. This provides two advantages to the user. First, walking aid 150 will provide more stability to the user than walking aids with conventional tips. Second, because the rigid supporting unit 110 prevents the base from being flexed or stressed, base 120 in walking aid tip 100 is less apt to crack and have to be replaced.

The size and shape of walking aid tip 100 produces several additional advantages. Diameter 270 of base 120 is preferably about three inches, which is many times more than the standard 0.75 inch diameter for a walking aid. As a result, the cross sectional area of base 120 is 16 times greater than the cross sectional area of walking aid 150. This increased surface area provides the user with greater stability on loose surfaces, such as sand and gravel.

In addition to the enormous size, base 120 contains a ground-engaging surface 175 that contains a curved region 170 that extends around the entire circumference of the device. Compared to a rocker tip, walking aid tip 100 need not be oriented in a particular direction before using. Regardless of the orientation of the walking aid tip 100, the base 120 will always maintain sufficient surface area contact with the ground throughout the entire stride. In contrast, a rocker tip must be oriented in a particular direction before using or adequate ground contact between the tip and the ground will not be achieved throughout an entire stride. Secondly, use of a rocker cane requires that the user, with each stride, not to tilt the cane either towards or away from himself. If however, walking aid tip 100 is employed, walking aid 150 would effectively work even if the cane was either tilted away or towards the user during a user's stride. This is because the ground engaging surface 175 of base 120 contains a curved region 170 that extends around the entire circumference of the device, providing for adequate contact with the ground for a wider variety of angles than that of a rocker.

FIG. 3 shows a cross section of the walking aid tip in FIG. 2 taken along line III–III'. FIG. 3 depicts a side view of the cross section of socket 210 and also shows hole 350 through which threaded member 140 is inserted in order to securely attach walking aid 150 to device 100.

It is contemplated that this invention may be practiced with several different embodiments. The first embodiment is shown in FIGS. 1, 2, and 3. The first embodiment is characterized by both the bottom side 182 of the supporting unit 110 and the adjoining top surface 184 of the rubber base 120 being flat surfaces in the shape of a circle. The top support surface 180 is parallel to the bottom surface of the socket 210 and rim 271 of socket 210 while the socket walls 190 and 273 are perpendicular to both the support surface 180 and the bottom of the socket.

Figure 4:
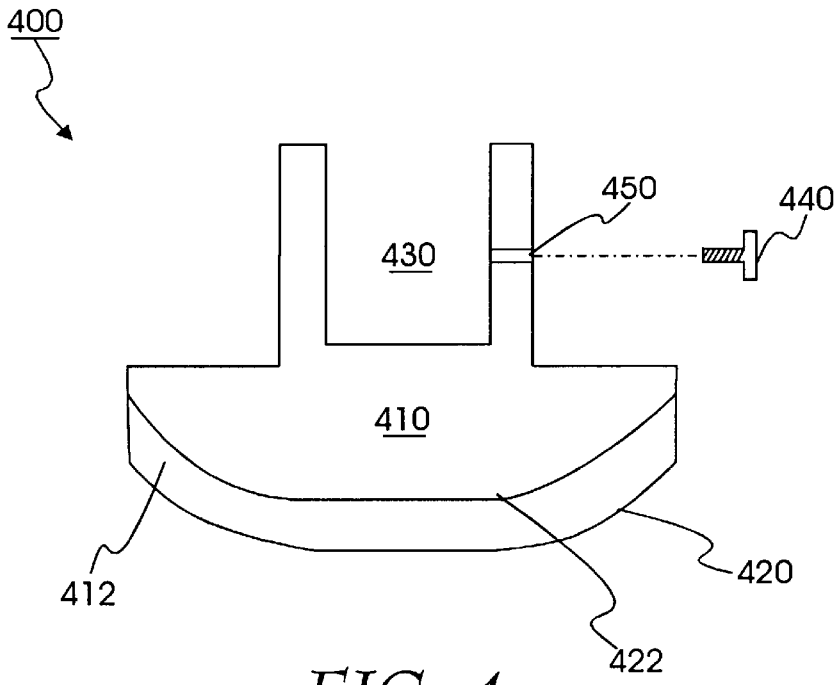
FIG. 4 is a cross sectional view of a second embodiment constructed according to the principles of the present invention.

A second embodiment is shown in FIG. 4. Screw 450 is inserted into hole 440 of support unit 410 to lock a cane into socket 430. The second embodiment differs from the first embodiment in that the bottom side of the rigid support unit 410 is convex and not flat. In addition, the upper surface 422 of the adjoining rubber base 420 is concave to provide a flush match with the bottom side 412 of support unit 410. By making rigid support unit 410 larger and rubber base 420 smaller, walking aid tip 400 shown in FIG. 4 is less apt to wobble, become unstable, or wear out by cracking than the embodiment shown in FIG. 3.

Figure 5:
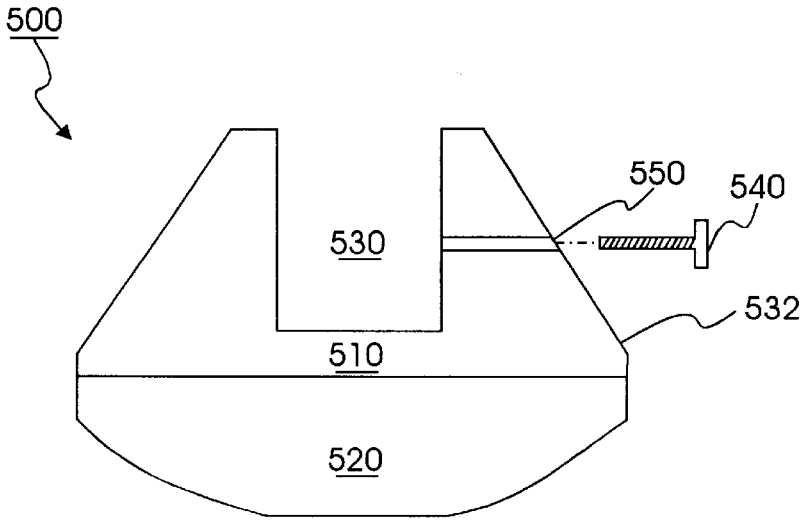
FIG. 5 is a cross sectional view of a third embodiment constructed according to the principles of the present invention.

A third embodiment is shown in FIG. 5, with screw 540 inserted into hole 550 of support unit 510 to hold a cane firmly in place inside socket 530. In FIG. 5, both the bottom side of the support unit and the upper surface of the rubber base are flat and formed in the shape of a circle. The top side 532 of support unit 510 is conical, preventing the accumulation of dirt on the top surface of walking aid tip 500. The supporting surface does not form a right angle with the socket wall. Instead, solid material, usually of aluminum or rigid plastic, fills in the support unit to form a cone as in FIG. 5, providing more support for rubber base 520, allowing for a cane that is less apt to wobble or become unstable when in use.

EXAMPLE 1

One embodiment of the present invention was constructed using the walking aid tip of FIG. 3. The diameter of the entire device 270 was three inches, the diameter of the center region 160 of base 120 was one inch, the curved region 170 of the ground engaging surface of base 120 had a convex surface formed by a stamping machine with a die that stamps a rubber base device having a radius of curvature of 2.25 inches, inner diameter 260 of socket 210 in supporting unit 110 is 0.8 inches, the outer diameter 276 of socket 210 is 1.3 inches, the height 275 of supporting unit 110 is 1.25 inches, the height 272 of the interior socket walls 273 is one inch, and the height 274 of the exterior socket walls 190 is 1.125 inches. Hole 350 to accommodate a ¼-20UNC ½ inch long threaded screw 140 in socket wall 190 is centered 0.375 inches from rim 271 of socket 210. The outer edge 281 or rim 271 of socket 210 is chamfered to form an arc of a circle having a radius of 0.125 inches, while the corner 282 formed at the intersection of outer side wall 190 of socket 210 and supporting surface 180 forms the arc of a circle having a radius of 0.25 inches. The rubber base has a maximum thickness of 0.75 inches, requiring it to be manufactured from recycled mine conveyor belt rubber preferably of at least 0.75 inches in thickness, if available. If a 0.5 inch thick carcass is available, that would also work. The typical dimensions for the second and third embodiments are similar to those given for the first embodiment with some discrepancies. In particular, the base in the second embodiment shown in FIG. 4 is made from recycled mine conveyor belt rubber having a thickness of only 0.25 inches while the base of the third embodiment in FIG. 5, like the base of the first embodiment in FIG. 3, is shown to be made from recycled mine belt rubber having a thickness of 0.75 inches.

EXAMPLE 2

Curved region 170 on ground engaging side 175 of rubber base 120 enables walking aid 150 to make a stable contact throughout the entire gait cycle or stride of the user. Diameter 270 of base 120 is three inches, the diameter of flat region 160 is one inch, leaving a one inch thick ring for curved region 170. Since the radius of curvature for curved region 170 is 2.25 inches, curved surface 170 at periphery 176 forms a 26.5 degree angle with the horizontal. As a result, walking aid tip 100 enables a user to form an effective contact between the walking aid and the ground when the longitudinal axis of walking aid 150 is within 26.5 degrees of the normal of the ground surface. This range of angles is wide enough so that it will provide support and ample surface area contact throughout an entire gait cycle of the user.

The foregoing details describe an improved tip for an ambulatory appliance that is easy to use and provides for better support on smooth or slippery surfaces. The tip combines the features of an enlarged base for better stability on sand and gravel, a combination of convex and flat base to provide support for the user when the walking aid is positioned at a wide variety of angles with the ground surface where the user is walking or standing still, a base made of a non-flexible rubber material so that the cane does not wobble and become unstable when in use and so that the base does not crack easily and have to be replaced frequently, an enlarged rigid support member that entirely covers and supports the rubber base so that the cane is less apt to wobble and so that the base is less likely to crack and have to be replaced prematurely, and a socket, a threaded screw, and a threaded screw hole to allow for easy installation of the tip. The enlarged base also allows people who would normally have to use a more cumbersome quad-cane (e.g., with four heads) to use a more streamlined but yet supportive single head cane tip.

While I have shown and described certain present preferred embodiments of the invention and have illustrated certain present preferred methods of practicing the same it is to be distinctly understood that the invention is not limited thereto but may be otherwise variously embodied and practiced within the scope of the following claims.

What is claimed is:

1. A walking aid tip, comprising:

a disk-shaped base having a ground-engaging surface and a non-ground-engaging surface, said disk-shaped base having a central region of said ground engaging surface surrounded by a circular ring-shaped outer region of said ground engaging surface, said outer region of said ground engaging surface extending from said central region to a circular periphery of said base, said base exhibiting a fist radial dimension within a plane including said central region;

said outer region of said ground-engaging surface having a convex surface and a first radius of curvature;

said central region of said ground-engaging surface having a second radius of curvature substantially greater than said first radius of curvature;

an outer region of said non-ground engaging surface having a flat surface extending between said periphery of said base and a central region of said non-ground-engaging surface; and a core with a third surface extending transversely to said plane exhibiting a second radial dimension collinear with said first radial dimension within said plane, with said first radial dimension being at least twice as large as said second radial dimension, and having one end centrally mounted upon said central region of said non-ground engaging surface, and having a second and opposite end disposed to retentively receive in juxtaposition to said transverse surface and terminate an enlongated shaft of a walking aid.

2. The walking aid tip of claim 1, further comprised of said core being mounted upon said central region of said non-ground engaging surface with said core extending perpendicularly away from said base.

3. The walking aid tip of claim 1, with a flat surface of said central portion of said ground engaging surface being parallel to a flat surface of said outer region of said non-ground engaging surface.

4. The walking aid tip of claim 1, with said base being comprised of Styrene-butadiene material reinforced with nylon.

5. The walking aid tip of claim 1, with said base being comprised of Styrene-butadiene material reinforced with polyester.

6. A walking aid tip, comprising:

a disk shaped base having a ground engaging side and a non-ground engaging side both symmetrically disposed around a geometric axis, said ground engaging side having a central portion, a periphery, and an outer portion extending from said central portion to said periphery, said non-ground engaging side having a central portion, a periphery, and a circular ring-shaped outer portion extending from said central portion of said non-ground engaging side to said periphery, said base exhibiting a first diametric dimension within a plane including said central portion of said non-ground engaging side:

said central portion of said ground engaging side defining a first and substantially infinite radius of curvature along said axis;

said outer portion of said ground engaging side bearing an exterior surface having a convexly curved profile defining a second radius of curvature substantially smaller than said first radius of curvature along said axis;

said outer portion of said non-ground engaging side being substantially flat; and a core with a transverse surface extending transversely to said plane exhibiting a second diametric dimension of an external feature of said core, with said second diametric dimension being collinear with said first diametric dimension within said plane, and with said first diametric dimension being at least twice as large as said second diametric dimension, said core having one end centrally mounted upon said central portion of said non-ground engaging surface, and having a second and opposite end disposed to retentively receive in juxtaposition to said transverse surface and terminate an elongated shaft of a walking aid.

7. The walking aid tip of claim 6, further comprised of said periphery of said non-ground engaging side being coincidental to said periphery of said ground engaging side.

8. The walking aid tip of claim 6, further comprised of the diameter of said central portion of said ground engaging side being more than one-half of the diameter of said outer portion of said ground engaging side.

9. The walking aid tip of claim 6, further comprised of said central portion of said ground engaging side being parallel to said flat surface of said outer portion of said non-ground engaging side.

10. The walking aid tip of claim 6, further comprised of said base being comprised of Styrene-butadiene material reinforced with nylon.

11. The waling aid tip of claim 6, with said base being comprised of Styrene-butadiene material reinforced with polyester.

12. A walking aid tip, comprising:

a disk shaped base, said disk shaped base comprising:

a ground engaging side having a central portion symmetrically disposed along a geometric axis of said central portion exhibiting a first radius of curvature, a first periphery, and a ring shaped outer portion symmetrically disposed between said central portion of said ground engaging side and said first periphery, said outer portion exhibiting a second and substantially smaller radius of curvature along said axis;

a non-ground engaging side having a central portion bounded by a second periphery adjoining said first periphery;

said base exhibiting a first diametric dimension within a plane including said central portion of said non-ground engaging side;

a core extending away from said central portion of said non-ground engaging side with a transverse surface extending transversely from said plane exhibiting a second diametric dimension of an external feature of said core with said second diametric dimension being collinear with said first diametric dimension within said plane, and with said first diametric dimension being at least twice as large as said second diametric dimension, and said core having one end centrally mounted upon said central portion of said non-ground engaging surface, and having a second and opposite end disposed to retentively receive in juxtaposition to said transverse surface and terminate an elongated shaft of a waking aid.

13. The walking aid tip of claim 12, further comprised of said outer portion of said ground engaging side being convexly curved, and said first radius of curvature being substantially infinite.

14. The walking aid tip of claim 13, further comprised of said central portion of said ground engaging side being approximately parallel to said outer portion of said non-ground engaging side.

15. The walking aid tip of claim 14, further comprised of the diameter of said central portion of said ground engaging side is more than one half the diameter of said outer portion of said ground engaging side.

16. The walking aid tip of claim 15, further comprised of said periphery of said ground engaging side coinciding with said periphery of said non-ground engaging side.

17. The walking aid tip of claim 16, with said base being comprised of Styrene-butadiene material reinforced with nylon.

18. The walking aid tip of claim 16, said base being comprised of Styrene-butadiene material reinforced with polyester.

19. The walking aid tip of claim 12, further comprised of said central portion of said non-ground engaging side being perforated by an orifice extending along said axis.

20. A walking aid tip, comprising:

a rigid member having a top side and a bottom side, said top side being comprised of:

a central region in the center of said top side, comprised of a structure disposed to receive an end of a walking aid, and an outer region with the shape of a ring extending from said central region to a periphery and comprised of an enlarged supporting surface having a cross-sectional diameter that is at least twice as large as an exterior diameter of said structure; and a disk-shaped base having a ground-engaging surface and a non-ground-engaging side symmetrically disposed around said rigid member, said non-ground engaging side being abuttingly attached to and coinciding with said bottom side of said rigid member, said ground-engaging surface being comprised of:

a central region in the center of said ground-engaging surface having a geometric shape and having a flat surface, and an outer region extending outwardly from said central region to a periphery of said base, having the shape of a ring and having a convex surface, said periphery of said base mating with and being coincident with said periphery of said rigid member.

21. The walking aid tip of claim 20, further comprising:

a threaded member extending through a hole in said structure of said rigid member.

22. The walking aid tip of claim 20, with said base comprised of Styrene-butadiene material reinforced with a nylon or polyester.

23. A walking aid tip, comprising:

a rigid member having a top side and a bottom side, said top side is comprised of:

a central region of said top side positioned in the center of said top side and having a geometric shape disposed to receive an end of a walking aid, and an outer region having a shape of a ring extending from said central region to a periphery and comprised of an enlarged supporting surface having a cross-sectional diameter that is at least twice as large as an exterior diameter of said central region; and a disk-shaped base having a ground-engaging surface and a non-ground-engaging side symmetrically disposed around said rigid member, said non-ground engaging side being abuttingly attached to and coinciding with said bottom side of said rigid member, said ground-engaging surface being comprised of:

a central region of said ground-engaging surface in the center of said ground-engaging surface having a geometric shape and having a flat surface, and an outer region extending outwardly from said central region of said ground-engaging surface to a periphery of said base, said outer region of said ground-engaging surface having the shape of a ring and having a convex exterior surface, abuttingly adjoining said bottom side of said rigid member.

24. The walking aid tip of claim 23, further comprising:

a threaded member extending through a hole in said central region of said rigid member while engaging the end of a walking aid.

25. The walking aid tip of claim 23 with said base comprised of Styrene-butadiene material reinforced with a nylon or polyester.

26. The walking aid tip of claim 23, said ground-engaging surface of said base comprised of:

said central region in the center of said ground-engaging surface having the shape of a circle, and said outer region extending arcuately outwardly from said central region of said ground-engaging surface to said periphery of said base, and said convex exterior said surface being load bearing.

27. The walking aid tip of claim 6, further comprised of said base being solid.

28. The walking aid tip of claim 12, further comprised of said ground engaging side being solid and said non-ground engaging side being solid.

* * * * *